US006191101B1

(12) United States Patent
Jacques et al.

(10) Patent No.: US 6,191,101 B1
(45) Date of Patent: Feb. 20, 2001

(54) FABRIC SOFTENING COMPOSITIONS PROVIDING ENHANCED PERFORMANCE AND CONTAINING CATIONIC SOFTENERS AND FATTY AMIDES

(75) Inventors: Alain Jacques, Blegny (BE); Leopold Laitem, Lebanon, NJ (US)

(73) Assignee: Colgate-Palmolive Co., New York, NY (US)

( * ) Notice: Under 35 U.S.C. 154(b), the term of this patent shall be extended for 0 days.

(21) Appl. No.: 09/579,877

(22) Filed: May 26, 2000

(51) Int. Cl.[7] ..... C11D 1/62; C11D 3/32

(52) U.S. Cl. ..... 510/515; 510/501; 510/504; 510/329

(58) Field of Search ..... 510/501, 504, 510/515, 329

(56) References Cited

U.S. PATENT DOCUMENTS 3,956,350 * 5/1976 Pusch et al. ..... 260/404.5

* cited by examiner

*Primary Examiner*—Yogendra Gupta
*Assistant Examiner*—Charles Boyer
(74) *Attorney, Agent, or Firm*—Bernard Lieberman

(57) ABSTRACT

A stable, pourable and water dispersible fabric softening composition comprising:

(i) from about 2% to about 35%, by weight, of a combination of softening components (A) and (B) wherein: (A) is a cationic fabric softening compound; and (B) is a fatty amide compound;

(ii) from about 0 to about 10%, by weight, of a polysiloxane; and (iii) balance water and optionally adjuvants selected from the group consisting of perfumes; dyes; sequestrants; thickeners; and anti dye-transfer polymeric materials.

6 Claims, No Drawings

FABRIC SOFTENING COMPOSITIONS PROVIDING ENHANCED PERFORMANCE AND CONTAINING CATIONIC SOFTENERS AND FATTY AMIDES

FIELD OF THE INVENTION

This invention relates to liquid fabric softening compositions. More particularly, this invention relates to liquid fabric softening compositions which provide enhanced softening performance based on a combination of a cationic softener with a fatty amide type compound.

BACKGROUND OF THE INVENTION

Compositions containing quaternary ammonium salts or imidazolinium compounds having at least one long chain hydrocarbyl group are commonly used to provide fabric softening benefits when used in a laundry rinse operation. Compositions of this type have been the focus of the patent literature for many years.

But, there remains an ongoing, need to improve the feel of the clothes washed under domestic conditions, particularly where the clothes are washed more frequently with very effective detergents and washers. As a result, the textile finishes are progressively removed, the textile fibers are altered and the initial pleasant feel of the fabrics is progressively lost.

For more than 40 years now, fabric softening, compositions have been used to restore a pleasant feel and provide a perfume to washed clothing. The most popular forms have been the liquid rinse cycle fabric softeners and the dryer softener sheet.

However, there is a continuing demand for better performing products. Better fabric softening can be achieved either by increasing the dose of the softener (either through higher use dosage or higher product concentration) or by identifying better softeners or combinations of softeners.

It is, therefore, an object of the present invention to provide aqueous softening compositions containing combinations of softeners with superior softening. The efficacy of these combinations is such that the active concentration of the compositions can be kept within reasonable, well accepted limits, thereby making the manufacture process easier and extending the shelf life of the finished product.

It is another object of the invention to provide a liquid rinse cycle fabric softener capable of imparting superior softening benefits to fabrics due to the synergistic combination of a conventional cationic softener compound with a fatty amide type compound.

SUMMARY OF THE INVENTION

The above and other objects of the invention which will become apparent from the detailed description and Examples to follow is achieved by a stable, pourable aqueous liquid fabric softening composition comprising:

(i) from about 2% to about 35%, by weight, of a combination of softening components (A) and (B) wherein:
(A) is a cationic fabric softening compound; and
(B) is a fatty amide compound;

(ii) from about 0 to about 10%, by weight, of a polysiloxane; and (iii) balance water and optionally adjuvants selected from the group consisting of perfumes; dyes; sequestrants; thickeners; and anti dye-transfer polymeric materials.

In a preferred embodiment the cationic softening compound (A) is selected from the group consisting of:

(i) dialkyl quaternary ammonium compounds;

(ii) dialkyl fatty ester quaternary ammonium compounds; and (iii) alkyl imidazolinium compounds.

The fatty amide compound (B) is preferably an alkyl carbamidoethyl urea having the following structural formula:

(I)

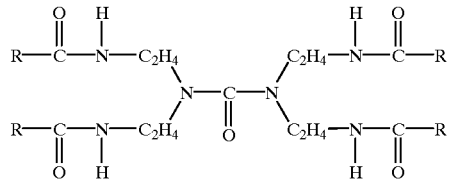

wherein R is a $C_{12}$ to $C_{22}$ alkyl group. Most preferably, R is $C_{17}H_{35}$.

Alternatively, the fatty amide compound (B) is an alkyl diethanolamide having the following structural formula:

(II)

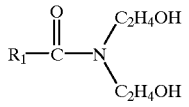

wherein $R_1$ is stearic ($C_{17}H_{35}$), or behenic ($C_{21}H_{43}$) or a mixture of both.

The present invention also provides a method of imparting softness to fabrics by contacting the fabrics with a softening effective amount of the fabric softening composition of the invention, and preferably in the rinse cycle of an automatic laundry washing machine. The compositions may be diluted with water prior to adding same to the washing machine (e.g. the rinse cycle dispenser), or may be added at reduced amount, without dilution, i.e., ready to use.

DETAILED DESCRIPTION AND PREFERRED EMBODIMENTS OF THE INVENTION

The cationic fabric softeners used in the present invention can be any of the commercially available and known cationic fabric softeners and preferably are of the water dispersible dialkyl quaternary ammonium compound salts, di(alkyl fatty ester) quaternary ammonium compound salts or alkyl imidazolinium salts.

The preferred cationic softening compound (A) for purposes of the present invention is a biodegradable fatty ester quaternary ammonium compound of the formula (III):

(III)

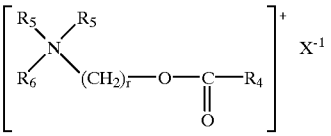

wherein $R_4$, independently, represents an aliphatic hydrocarbon group having from 8 to 22 carbon atoms; each of $R_5$ independently represent $(CH_2)_s$-$R_7$ (where $R_7$ represents an alkoxy carbonyl group containing from 8 to 22 carbon atoms, benzyl, phenyl, ($C_1$–$C_4$) alkyl substituted phenyl, OH or H); $R_6$ represents $(CH_2)_t$—$R_8$ (where $R_8$ represents benzyl, phenyl, ($C_1$–$C_4$) alkyl substituted phenyl, OH or H); r, s and t, each independently represent a number of from 1 to 3; and $X^{-1}$ is an anion of valence minus one.

Typical cationic fabric softener compounds include:

Distearyl dimethyl ammonium chloride

Ditallow dimethyl ammonium chloride

Dihexadecyl dimethyl ammonium chloride

Di (hydrogenated tallow) dimethyl ammonium chloride

N-Methyl-N,N-di($C_{16}$–$C_{18}$-acyloxy)-ethyl-N-(2-hydroxyethyl)ammonium methosulfate 2,3-di($C_{16}$–$C_{18}$-acyloxy)propyltrimethylammonium chloride N,N-dimethyl-N,N-di ($C_{16}$–$C_{18}$-acyloxy)-ethyl ammonium methosulfate 2-($C_{16}$–$C_{18}$-alkyl)-3-($C_{16}$–$C_{18}$-acyloxy)-ethylimidazolinium chloride Methyl-1-tallow amido-ethyl-2-tallow imidazolinium methyl sulfate Methyl-1-oleyl amido-ethyl-2-oleyl imidazolinium methyl sulfate The fatty ester quaternary ammonium compound described in formula III above is preferably a diester quat of the formula IV:

(IV)

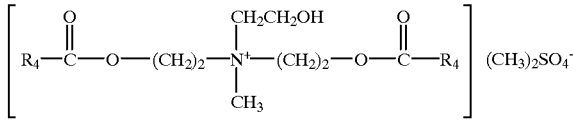

where each $R_4$ independently represent an aliphatic hydrocarbon group having from 8 to 22 carbon atoms and, may be, for example, derived from hard or soft tallow, coco, stearyl, oleyl, and the like. Such compounds are commercially available, such as, for example, Tetranyl AT-75, from Kao Corp. Japan, which is di-tallow ester triethanol amine quaternary ammonium methyl sulfate. Tetranyl AT-75 is based on a mixture of about 25% hard tallow and about 75% soft tallow. Accordingly, this product contains about 34% of unsaturated alkyl chains. A second example would be Hipochem X-89107, from High Point Chemical Corp.; which is an analogue of the Tetranyl AT-75 with about 100% saturation in the tallow moieties.

Because of the industrial production scale aspect of such ester quat compounds, variation of the quaternization level will result in the presence of quaternary ammonium compounds as well as the presence of fatty amines, or variation in the degree of esterification will result in the presence of mono, di and tri-alkyl derivatives, such fatty amines and alkyl derivatives being clearly materials which may be present in the compositions of the invention.

It is understood that the nature of the counter ions is not essential to the nature of the invention. They can be halides, such as chlorides, iodides, bromides or methosulfate, though the commercially available materials are mostly the chlorides or the methosulfates compounds.

The preferred fatty amide compounds of the present invention are represented by formula I above, and most preferably where R is $C_{17}H_{35}$.

Such fatty amides are generally described as condensation products of monobasic fatty acids having at least 8 carbon atoms with dipropylene triamine and or diethylene triamine. These condensates are subsequently reacted with urea. The resulting product is optionally methylolated by adding formaldehyde.

Typical compounds of this class are:

Bis/tetra stearyl carbamidoethyl urea.

Bis/tetra tallowyl carbamidoethyl urea.

The manufacture of such fatty amide compounds is described in U.S. Pat. No. 3,956,350 to Ciba-Geigy, the disclosure of which is incorporated herein by reference.

The cationic compounds (A) and fatty amide compounds (B) used in admixture, preferably at weight ratios of about 5:1 to about 1:5, more preferably from about 2:1 to about 1:2, and most preferably about 1:1 whereby both softening performance and stability and pourability are improved. The total amounts of components (A) and (B) is from about 2 to about 35 wt. percent, preferably from about 3 to about 30 wt %.

The compositions of this invention may optionally include an electrolyte to reduce dispersion viscosity. Generally, any of the alkaline metals or alkaline earth metal salts of the mineral acids can be used as electrolyte. In view of availability, solubility and low toxicity, NaCl, $CaCl_2$, $MgCl_2$ and $MgSO_4$ and similar salts of alkaline and alkaline earth metals are preferred, and $CaCl_2$ is especially preferred. The amount of the electrolyte will be selected to assure that the composition does not form a gel. Generally, amounts of electrolyte salt of from about 0.05 to 2.0 wt %, preferably 0.1 to 1.5 wt %, especially preferably 0.25 to 1.4 wt %, will effectively prevent gelation from occurring.

Optional ingredients that are known in the art of treating textiles can be used to further improve the stability, the aesthetics or the performance of the compositions of this invention.

Perfumes are additions to fabric softening compositions to enhance the freshness of laundered clothing.

The compositions of the invention often contain a fatty alcohol ethoxylate nonionic surfactant to emulsify the perfume present in the composition. The presence of an emulsifier insures the physical stability of the composition which may otherwise be destabilized by the presence of perfume or fragrance in the composition. The fatty alcohol ethoxylates useful in the invention correspond to ethylene oxide condensation products of higher fatty alcohols, with the higher fatty alcohol being of from about 9 to 15 carbon atoms and the number of ethylene oxide groups per mole being from about 5 to 30.

As used herein, the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes), the essential oils themselves being volatile odoriferous compounds and also serving to dissolve the other components of the perfume.

In the present invention, the particular composition of the perfume is of no importance with regard to the performance of the liquid fabric softener composition so long as it meets the criteria of water immiscibility and having a pleasing odor.

To prevent gelation of super-concentrated liquid compositions, the compositions may contain a polyethylene glycol polymer or polyethylene glycol alkyl ether polymer. The polyethylene glycol polymers useful herein have a molecular weight of at least 200 up to a molecular weight of about 8,000. Useful polymers include the polyethylene glycol and polyethylene glycol methyl ether polymers marketed by Aldrich Chemical Company. Useful amounts of polymer in the composition range from about 0.1% to about 5%, by weight. A range of from about 0.5 to about 1.5%, by weight, is preferred.

Examples of optional rheology modifiers and thickeners for use herein are well known in the art and may be chosen from, for example, polymeric rheology modifiers and inorganic rheology modifiers. Examples of the former type include cationic polymers such as copolymers of acrylamide and quaternary ammonium acrylate and the like. Generally, only minor amounts, up to about 1.0%, preferably up to about 0.8%, such as, for example, 0.01 to 0.60 percent, by weight, provide acceptable viscosity levels over time.

Other optional co-softeners for use herein are fatty alcohols, glycerol monostearate (GMS) and glycerol monooleate (GMO).

Other optional ingredients which may be used to reduce fabric wrinkling and enhance ease of ironing are nonionic humectants, inorganic salts, film forming polymeric materials such as polyacrylates, polymethacrylates, silicones, starch derivatives and polyolefins waxes.

Anti dye transfer polymeric materials, such as polyvinylpyrrolidone type compounds may also be added to the present compositions.

Sequestering materials such as polyphosphonates, polycarboxylic materials can be used to neutralize water impurities such as mineral salts (calcium, magnesium, iron, copper) to protect the colors of the clothes.

Other optional components commonly used in fabric softening compositions may be added in minor amounts to enhance either the appearance or performance properties of the liquid fabric softener compositions of this invention. Typical components of this type include, but are not limited to colorants, e.g., dyes or pigments, bluing agents, preservatives, germicides, and perfumes.

The final product, whether in concentrated or diluted form must be easily pourable by the end user. Generally, therefore, final product viscosity (for a freshly prepared sample) should not exceed about 1500 centipoise, preferably not more than 1000 centipoise, but should not be too low, for example not less than about 50 centipoise. The preferred viscosity for the invention concentrated product is in the range of 120 to 1000 cps. As used herein, unless otherwise specified, viscosity is measured at 25° C. (22–26° C.) using a Brookfield RVTD Digital Viscometer with Spindle #2 at 50 rpm.

Concentrated compositions may be diluted by a factor of generally 4:1 or more, preferably up to about 8:1 or even 10:1. Concentrated products with up to about 35 weight percent of softeners may be prepared and will remain pourable and stable against phase separation or suspended particle agglomeration for extended periods of time. For example, a composition with about 28% of softeners can be diluted to about 5% actives to provide equivalent or superior softening performance to a product containing about 7% of DTDMAC (ditallow dimethyl ammonium chloride). After dilution, or for a ready-to-use product, the composition will normally contain sufficient softener to be effective when added to the rinse water in an amount of about one-eighth to three-quarters of a cup (1 to 6 ounces) providing about 50 ppm to about 250 ppm of softener in the rinse water.

The compositions of the present invention are able to provide additional benefits beyond fabric softening to fabrics and laundry which are conditioned with such compositions. Principally, it is noted that these compositions provide improved color protection by dye transfer inhibition to treated fabrics, as well as improved care benefits by minimizing fabric abrasion. This has the effect of enhancing fabric appearance and extending fabric longevity.

The following formulas illustrate useful compositions in accordance with the invention. All mentioned ingredients are given as 100% active.

DTDMAC=Ditallow dimethyl ammonium chloride or di(alkyl fatty ester) quaternary ammonium.

Fatty amide mixture (FAM)=59.5% of Bis/tetra stearyl carbamidoethyl urea/40.5% of stearic/behenic acid diethanolamide.

Silicones were used as optional ingredients.

The balance of each formula consisted of water, dye, perfume and preservative.

Regular Concentration Formulas

Composition A

2% Cationic softener/3.2% Fatty amide mixture/1% Silicone
2% DTDMAC/3.2% Fatty amide mixture/1% Wacker VP1445E or Dow Corning X2-7589

Composition B

2% Cationic softener/3.2% Fatty amide urea/1% Silicone
2% DTDMAC/3.2% bis/tetra stearylcarbamidoethyl urea/1% VP1445E or Dow Corning X2-7589 Polysiloxane Composition C 2% Cationic softener/3.2% Stearyl diethanolamide/1% Silicone
2% DTDMAC/3.2% stearyl/behenic diethanolamide/1% VP1445E or X2-7589 Polysiloxane Concentrated Formulas Composition D 4% Cationic softener/6.4% Fatty amide mixture/2% Silicone
4% DTDMAC, 6.4% Fatty amide mixture, 2% Wacker VP1445E or Dow Corning X2-7589

Composition E

6% cationic softener/9.6% Fatty amide mixture/3% Silicone
6% DTDMAC/9.6% Fatty amide mixture/3% Wacker VP1445E or Dow Corning X2-7589

EXAMPLE 1

The evaluation of softness performance in the Examples herein was conducted under the following conditions: A mini-cycle softening test was used to duplicate the rinse cycle of a European washing machine with 3 kg fabric for 25 liters water. A rotating drum was used to treat the fabrics with the softener rinse liquor. Terry cloths were 2 times desized and 6 times hardened. Tap water had 300 ppm hardness and a pH of about 8.

Synergy Between DTDMAC and Fatty Amide Mixture

The softness of several compositions of the invention was compared. The test compositions contained 6% of total softening actives including combinations of the fatty amide mixture and DTDMAC versus the control composition which contained 6% of DTDMAC as the sole softening ingredient. Dosage was 110 ml. per wash.

A panel of 6 trained judges evaluated the softness of the treated towels and ranked them in the following order of decreasing softness.

| | |
|---|---|
| 1. | 2% DTDMAC/4% Fatty amide mixture |
| 2. | 1% DTDMAC/5% Fatty amide mixture |
| 3. | 3% DTDMAC/3% Fatty amide mixture |
| 4. | 4% DTDMAC/2% Fatty amide mixture |
| 5. | 5% DTDMAC/1% Fatty amide mixture |
| 6 | 6% DMDTAC |

Based on the above data, mixtures of DTDMAC/Fatty amide mixture imparted greater softness to fabrics than an equivalent amount of DTDMAC alone. Further, the optimum ratio of cationic softener to fatty amide mixture was 2:4.

EXAMPLE 2

Following the test methodology of Example 1 the performance of a mixture of DTDMAC/fatty amide mixture and silicone was compared to a control composition of DTDMAC.

The composition of the invention contained 2% DTDMAC, 3.2% fatty amide mixture and 1% Wacker polysiloxane. Dosage was 110 ml/wash for the composition of the invention and 275 ml/wash for the control composition of 5% DTDMAC which is equivalent to 12.5% DTDMAC at a dosage of 110 ml/wash.

A panel of 6 trained judges evaluated the softness of the towels and rated the composition of the invention as providing superior softness than the control composition.

What is claimed is:

1. A stable, pourable and water dispersible fabric softening composition comprising:

(i) from about 2% to about 35%, by weight, of a combination of softening components (A) and (B) wherein:
(A) is a cationic fabric softening compound; and
(B) is a fatty amide compound;

(ii) from about 0 to about 10%, by weight, of a polysiloxane; and (iii) balance water and optionally adjuvants selected from the group consisting of perfumes; dyes; sequestrants; thickeners; and anti dye-transfer polymeric materials;

wherein said cationic softening compound (A) is selected from the group consisting of:
(i) dialkyl quaternary ammonium compounds;
(ii) dialkyl fatty ester quaternary ammonium compounds; and
(iii) alkyl imidazolinium compounds;

and said fatty amide compound (B) is an alkyl carbamidoethyl urea having the following structural formula:

(I)

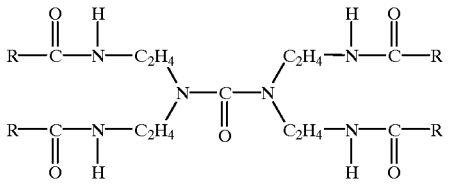

wherein R is a $C_{12}$ to $C_{22}$ alkyl group.

2. The fabric softening composition of claim 1 wherein in formula (I), R is $C_{17}H_{35}$, to form the compound bis/tetra stearyl carbamidoethyl urea.

3. The fabric softening composition of claim 1 wherein said cationic softening compound (A) is a biodegradable fatty ester quaternary ammonium compound of the formula (III):

(III)

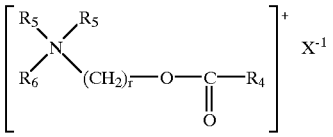

wherein $R_4$, independently, represents an aliphatic hydrocarbon group having from 8 to 22 carbon atoms; each of $R_5$ independently represent $(CH_2)_s$—$R_7$ (where $R_7$ represents an alkoxy carbonyl group containing from 8 to 22 carbon atoms, benzyl, phenyl, ($C_1$–$C_4$) alkyl substituted phenyl, OH or H); $R_6$ represents $(CH_2)_t$—$R_8$ (where $R_8$ represents benzyl, phenyl, ($C_1$–$C_4$) alkyl substituted phenyl, OH or H); r, s and t, each independently represent a number of from 1 to 3, and $X^{-1}$ is an anion of valence minus one.

4. The fabric softening composition of claim 3 wherein the fatty ester quaternary ammonium compound is a diester compound having the following structural formula IV:

(IV)

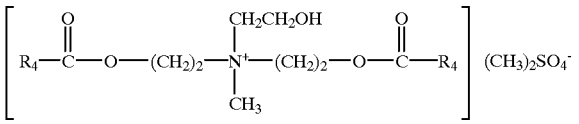

wherein each $R_4$ independently represents the aliphatic hydrocarbon group as defined above.

5. A method of imparting softness to fabrics comprising contacting said fabrics with an effective amount of the fabric softening composition of claim 1.

6. The method of claim 5 wherein said fabrics are contacted during the rinse cycle of an automatic laundry washing machine.

* * * * *